US005897768A

United States Patent [19]

McVicker et al.

[11] Patent Number: 5,897,768

[45] Date of Patent: Apr. 27, 1999

[54] DESULFURIZATION PROCESS FOR REMOVAL OF REFRACTORY ORGANOSULFUR HETEROCYCLES FROM PETROLEUM STREAMS

[75] Inventors: Gary B. McVicker, Califon; Teh C. Ho, Bridgewater; Stuart Soled, Pittstown, all of N.J.; Michel Daage, Baton Rouge, La.; Roman Krycak, Annandale, N.J.; Sabato Miseo, Pittstown, N.J.; Viktor Buchholz, Branchburg, N.J.; William E. Lewis, Baton Rouge, La.

[73] Assignee: Exxon Research and Engineering Co., Florham Park, N.J.

[21] Appl. No.: 08/808,100

[22] Filed: Feb. 28, 1997

[51] Int. Cl.[6] ..... C10G 45/04

[52] U.S. Cl. ..... 208/215; 208/208 R; 208/209; 208/213; 208/214; 208/216 R; 208/217

[58] Field of Search ..... 208/208 R, 209, 208/213, 214, 215, 216 R, 217

[56] References Cited

U.S. PATENT DOCUMENTS

| | | | |
|---|---|---|---|
| 1,932,369 | 10/1933 | Guthke | 208/215 |
| 2,406,200 | 8/1946 | Cole | 208/215 |
| 2,531,767 | 11/1950 | Chenicek | 208/212 |
| 2,771,401 | 11/1956 | Shepherd | 208/210 |
| 2,890,165 | 6/1959 | Bednars et al. | 208/89 |
| 3,849,296 | 11/1974 | Hensley, Jr. | 208/216 |
| 4,272,400 | 6/1981 | Silbernagel et al. | 252/413 |
| 4,272,401 | 6/1981 | Mohan et al. | 252/413 |
| 4,313,820 | 2/1982 | Farha, Jr. et al. | 208/213 |
| 4,314,901 | 2/1982 | Nowack et al. | 208/216 R |
| 4,376,699 | 3/1983 | Gardner | 208/215 |
| 4,443,329 | 4/1984 | Eberly, Jr. et al. | 208/111 |
| 4,560,470 | 12/1985 | McCarty et al. | 208/215 |
| 4,595,672 | 6/1986 | Ho et al. | 502/219 |
| 4,655,905 | 4/1987 | Plumail et al. | 208/216 R |
| 4,659,454 | 4/1987 | Varghese et al. | 208/111 |
| 4,663,023 | 5/1987 | McCandlish | 208/112 |
| 4,668,376 | 5/1987 | Young et al. | 208/108 |
| 4,812,227 | 3/1989 | Jacobson et al. | 208/215 |
| 4,960,506 | 10/1990 | Halbert et al. | 208/215 |
| 5,011,593 | 4/1991 | Ware et al. | 208/213 |
| 5,164,354 | 11/1992 | Aldridge et al. | 502/220 |
| 5,252,199 | 10/1993 | Singhal et al. | 208/254 H |
| 5,334,775 | 8/1994 | Gutierrez | 568/791 |
| 5,391,532 | 2/1995 | Soled et al. | 502/210 |
| 5,420,092 | 5/1995 | Soled et al. | 502/210 |
| 5,489,733 | 2/1996 | Soled et al. | 585/740 |
| 5,543,036 | 8/1996 | Chang et al. | 208/189 |
| 5,593,570 | 1/1997 | Habib et al. | 208/108 |

OTHER PUBLICATIONS

Isoda et al, "HDS Reactivity", Am. Chem. Sec. Symposium, Aug., 1996, pp. 563–566.

Isoda et al., "HDS Reactivity", Am. Chem. Sec. Symposium, Aug. 1996, pp. 559–562.

Mochida et al., "Deep Hydrodesulfurization", Catalysts Today 29 (1996) 185–186–no month.

*Primary Examiner*—Walter D. Griffin
*Assistant Examiner*—Nadine Preisch
*Attorney, Agent, or Firm*—E C Bakun

[57] ABSTRACT

Hydrocarbon feeds are upgraded by contact of the stream under hydrodesulfurization (HDS) conditions with a catalyst system comprising a sulfided, transition metal promoted tungsten/molybdenum HDS catalyst, e.g., Ni/Co—Mo/$Al_2O_3$ and a solid acid catalyst which is effective for the isomerization/disproportionation/transalkylation of alkyl substituted, condensed ring heterocyclic sulfur compounds present in the feedstream, e.g. zeolite or a heteropolyacid compound. Isomerization, disproportionation and transalkylation reactions convert refractory sulfur compounds such as 4- or 4,6-alkyl dibenzothiophenes into corresponding isomers or disproportionated isomers which can be more readily desulfurized by conventional HDS catalysts to $H_2S$ and other products.

26 Claims, 1 Drawing Sheet

DESULFURIZATION PROCESS FOR REMOVAL OF REFRACTORY ORGANOSULFUR HETEROCYCLES FROM PETROLEUM STREAMS

FIELD OF THE INVENTION

The present invention relates to a process for the deep hydrodesulfurization (HDS) of petroleum and petrochemical streams by removing refractory sterically hindered sulfur atoms from multiring heterocyclic organosulfur compounds.

BACKGROUND OF THE INVENTION

Hydrodesulfurization is one of the key catalytic processes of the refining and chemical industries. The removal of feed sulfur by conversion to hydrogen sulfide is typically achieved by reaction with hydrogen over non-noble metal sulfides, especially those of Co/Mo and Ni/Mo, at fairly severe temperatures and pressures to-meet product quality specifications or to supply a desulfurized stream to a subsequent sulfur sensitive process. The latter is a particularly important objective because many processes are carried out over catalysts which are extremely sensitive to poisoning by sulfur. This sulfur sensitivity is sometimes sufficiently acute as to require a substantially sulfur free feed. In other cases environmental considerations and mandates drive product quality specifications to very low sulfur levels.

There is a well established hierarchy in the ease of sulfur removal from the various organosulfur compounds common to refinery and chemical streams. Simple aliphatic, naphthenic, and aromatic mercaptans, sulfides, di- and polysulfides and the like surrender their sulfur more readily than the class of heterocyclic sulfur compounds comprised of thiophene and its higher homologs and analogs. Within the generic thiophenic class, desulfurization reactivity generally decreases with increasing molecular structure and complexity. While simple thiophenes represent the relatively liable sulfur types, the other extreme, which is sometimes referred to as "hard sulfur" or "refractory sulfur", is represented by the derivatives of dibenzothiophene, especially those mono- and di-substituted and condensed ring dibenzothiophenes bearing substituents on the carbons beta to the sulfur atom. These highly refractory sulfur heterocycles resist desulfurization as a consequence of steric inhibition precluding the requisite catalyst-substrate interaction. For this reason, these materials survive traditional desulfurization and they poison subsequent processes whose operability is dependent upon a sulfur sensitive catalyst. Destruction of these "hard sulfur" types can be accomplished under relatively severe process conditions, but this may prove to be economically undesirable owing to the onset of harmful side reactions leading to feed and/or product degradation. Also, the level of investment and operating costs required to drive the severe process conditions may be too great for the required sulfur specification.

A recent review (M. J. Girgis and B. C. Gates, Ind. Eng. Chem., 1991, 30, 2021) addresses the fate of various thiophenic organosulfur types at reaction conditions employed industrially, e.g., 340–425° C. (644–799° F.), 825–2550 psig. For dibenzothiophenes, the substitution of a methyl group at the 4-position or at the 4- and 6-positions decreases the desulfurization activity by more than an order of magnitude. These authors state, "These methylsubstituted dibenzothiophenes are now recognized as the organosulfur compounds that are most slowly converted in the HDS of heavy fossil fuels. One of the challenges for future technology is to find catalysts and processes to desulfurize them."

M. Houalla et al, J. Catal., 61, 523 (1980) disclose activity debits of several orders of magnitude for similarly substituted dibenzothiophenes under similar hydrodesulfurization conditions. While the literature addresses methyl substituted dibenzothiophenes, it is apparent that substitution with alkyl substituents larger than methyl, e.g., 4,6-diethyldibenzothiophene, would intensify the refractory nature of these sulfur compounds. Condensed ring aromatic substituents incorporating the 3,4 and/or 6,7 carbons would exert a similar negative influence. Similar results are described by Lamure-Meille et al, Applied Catalysis A: General, 131, 143, (1995) based on similar substrates.

Mochida et al, Catalysis Today, 29, 185 (1996) address the deep desulfurization of diesel fuels from the perspective of process and catalyst designs aimed at the conversion of the refractory sulfur types, which "are hardly desulfurized in the conventional HDS process." These authors optimize their process to a product sulfur level of 0.016 wt. %, which reflects the inability of an idealized system to drive the conversion of the most resistant sulfur molecules to extinction. Vasudevan et al, Catalysis Review, 38, 161 (1996) in a discussion of deep HDS catalysis report that while Pt and Ir catalysts were initially highly active on refractory sulfur species, both catalysts deactivated with time on oil.

In light of the above, there remains a need for a desulfurization process that will convert feed containing the refractory, condensed ring sulfur heterocycles at relatively mild process conditions to products substantially free of sulfur.

SUMMARY OF THE INVENTION

The present invention provides a process for hydrorefining a hydrocarbon stream containing alkyl substituted, condensed ring sulfur heterocyclic sulfur compounds comprising contacting said stream under hydrodesulfurization conditions and in the presence of hydrogen with a catalyst system comprising:

a) a hydrodesulfurization catalyst comprising a sulfided transition metal promoted molybdenum and/or tungsten metal catalyst; and b) a solid acid catalyst effective for the isomerization and/or transalkylation of alkyl substituent groups present on said heterocyclic compounds under said hydrodesulfurization conditions.

In this embodiment, hydrodesulfurization may be carried out by contacting the stream under hydrodesulfizing conditions with at least one catalyst bed which may comprise a mixture of hydrodesulfurization (HDS) catalyst (a) and isomerization (ISOM) catalyst (b) or with staged catalyst beds, a first stage bed containing HDS catalyst (a), a second stage bed containing ISOM catalyst (b) and a third stage bed containing HDS catalyst (a).

In a second embodiment of the invention, a process is provided for hydrorefining a hydrocarbon stream containing alkyl substituted condensed ring heterocyclic sulfur compounds comprising:

(a) contacting said stream in a first reaction zone under hydrodesulfurization conditions with a catalyst comprising a sulfided, transition metal promoted molybdenum and/or tungsten metal catalyst;

(b) withdrawing an effluent stream from said first zone containing both light and heavy refractory sulfur compounds;

(c) separating said light sulfur compounds from said effluent stream to form a second stream containing said refractory heterocyclic sulfur compounds;

(d) contacting at least a portion of said second stream in a second reaction zone with a solid acid catalyst under conditions of temperature and pressure and in the presence of hydrogen effective for the isomerization of alkyl substituent groups present on said refractory heterocyclic sulfur compounds; and (e) recycling the effluent from said second reaction zone back to said first reaction zone and subjecting said effluent to said hydrodesulfurization conditions.

In the preferred embodiments of the invention, the HDS catalyst comprises a sulfided cobalt or nickel/molybdenum catalyst and the solid acid catalyst comprises an acidic zeolite or a heteropolyacid compound or derivative thereof.

BRIEF DESCRIPTION OF THE DRAWING

The figure shows a flow diagram of a preferred embodiment of the process of this invention.

DETAILED DESCRIPTION OF THE INVENTION

Figure 1:
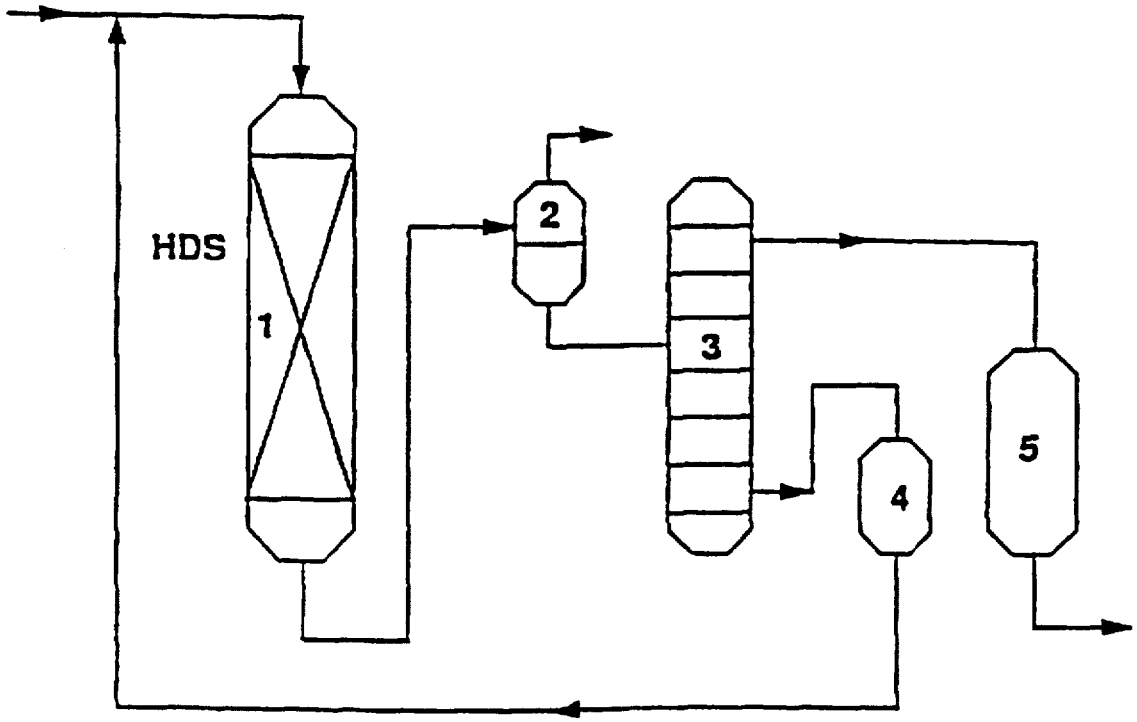

In accordance with this invention, a process is provided for converting hard-to-remove sulfur compounds (hereafter referred to as refractory sulfurs) present in petroleum streams into easy-to-remove sulfurs (hereafter referred to as easy sulfurs) such that streams of reduced sulfur content which are substantially free of sulfur compounds can be achieved. As indicated above, refractory sulfurs naturally present in such streams generally include alkyl dibenzothiophene (A-DBT) compounds which contain one or more $C_1$ to $C_4$ alkyl, e.g. methyl through butyl or even higher, substituent groups present on carbons beta to the sulfur atom, i.e., at the 4 and/or 6 positions on the DBT ring structure. Whereas conventional HDS catalysts are reactive under HDS conditions with easy sulfurs including DBT and A-DBTs containing one or more substituent groups at the least hindered 1–3 and/or 7–9 ring positions, they are significantly less reactive under HDS conditions with 4 and/or 6 substituted DBTs because steric hindrance prevents substantial contact of the sulfur heteroatom with the HDS catalyst. The present invention provides a technique for moving or removing substituent groups from the 4 and/or 6 positions on the DBT ring via isomerization/disproportionation reactions, thereby forming A-DBT substrates which are more susceptible to conversion with conventional HDS catalysts forming $H_2S$ and the resulting hydrocarbon products.

The hydrorefining process of the invention may be applied to a variety of feedstreams, e.g., solvents, light, middle, or heavy distillate, gas oils and residual feed, or fuels. In hydrotreating relatively light feeds, the feeds are treated with hydrogen, often to improve odor, color, stability, combustion characteristics, and the like. Unsaturated hydrocarbons are hydrogenerated, and saturated. Sulfur and nitrogen are removed in such treatments. In the hydrodesulfurization of heavier feedstocks, or residue, the sulfur compounds are hydrogenated and cracked. Carbon-sulfur bonds are broken, and the sulfur for the most part is converted to hydrogen sulfide which is removed as a gas from the process. Hydrodenitrogenation also generally accompanies hydrodesulfurization reactions to some degree.

Suitable HDS catalysts which may be used in accordance with this invention include the well known transition metal promoted molybdenum and/or tungsten metal sulfide catalysts, used in bulk or impregnated on an inorganic refractory oxide support such as silica, gamma-alumina or silica alumina. Preferred HDS catalysts include oxides of cobalt and molybdenum on alumina, of nickel and molybdenum on alumina, oxides of cobalt and molybdenum promoted with nickel, of nickel and tungsten and the like. Another preferred HDS catalyst comprises a supported, self-promoted catalyst obtained by heating said support material and one or more water soluble catalyst precursors of the formula $ML(Mo_y W_{1-y}O_4)$ in a non-oxidizing atmosphere in the presence of sulfur or one or more sulfur bearing compounds for a time sufficient to form said catalyst, wherein M comprises one or more divalent promoter metals selected from the group consisting of Mn, Fe, Co, Ni, Cu, Zn and mixtures thereof, y is a value ranging from 0 to 1 and L is one or more neutral, nitrogen-containing ligands, at least one of which is a chelating polydentate ligand.

Suitable HDS catalysts of this type include tris (ethylenediamine) nickel molybdate and tris (ethylenediamine) cobalt molybdate. These HDS catalysts and their method of preparation are more completely disclosed in U.S. Pat. No. 4,663,023 the complete disclosure of which is incorporated herein by reference.

The second component of the catalyst system of this invention comprises a solid acid catalyst which is effective for the isomerization and/or transalkylation of alkyl substituent groups present in the condensed ring sulfur heterocyclic compounds under HDS reaction conditions. The solid acid catalyst preferably comprises oxides which will not become sulfided in the presence of a sulfur containing compound under typical hydrodesulfurization conditions. Isomerization reactions, i.e., the conversion of an organic compound into one or more isomers, are usually accompanied by disproportionation reactions which produce homologous species of the organic compound. Thus, the solid acid catalysts used in this invention are those capable of converting mono- or dialkyl substituted 4 or 4,6 dibenzothiophenes (DBT) into isomers and homologous compounds which are more susceptible to reaction with the HDS catalyst component of the catalyst system, e.g., the conversion of 4-ethyl DBT into one or more 1–3 or 7–9 positioned ethyl DBT isomers as well as disproportionation to mixed species including such species as DBT and $C_4$-DBT.

Preferred solid acid catalysts include crystalline or amorphous aluminosilicates sulfated and tungstated zirconia, niobic acid, aluminophosphates and supported or bulk heteropolyacids or derivatives thereof.

Suitable crystalline aluminosilicates include the acid form of zeolites wherein the alkali or alkaline earth metal cation present in the zeolite structure is replaced with hydrogen, such as by ion exchange of the cation with ammonium cations followed by calcination to drive off ammonia. Preferred such zeolites include HY, HX, HL, mordenite, zeolite beta and other analogous zeolites known to those skilled in the art which are capable of isomerizing A-DBT compounds. Zeolites which are modified by incorporation of a metal which promotes hydrogenation may also be used. Suitable such metals include noble metals such as platinum or palladium as well as other metals such as nickel, zinc, rare earth metals and the like.

Suitable heteropolyacid compounds which may be used include those of the structure $H_z D_t^{+n} XM_{12}O_{40}$ wherein $z+nt=3$, $0 \leqq z$, $t \leqq 3$, D is a metal cation of valence n, X is a hetero atom selected from the group consisting of one or more metals, metalloids or non-transition metals of Groups III A to VA, and M is a poly atom comprising one or more Group V B or VI B transition metals.

Useful heteropoly catalysts may be used in bulk or supported form, and include the free acids (e.g., $H_3XM_{12}O_{40}$) such as phosphotungstic acid (also known as "12-tungstophosphoric acid" in the literature), borotungstic acid, titanotungstic acid, stannotungstic acid, phosphomolybdic acid, silicomolybdic acid, silicotungstic acid, arsenomolybdic acid, teluromolybdic acid, aluminomolybdic acid, phosphovanadyltungstic acid (i.e. $H_4PW_{11}VO_{40}$), and the like, as well as the corresponding salts and acid salts thereof.

The corresponding heteropoly salts and acid salts may include monovalent, divalent, trivalent and tetravalent inorganic and/or organic cations such as, for example, sodium, copper, cesium, silver, ammonium, and the like that have completely (salts) or partially (acid salts) ion-exchanged with the parent heteropoly acid (e.g., $Cs_3PW_{12}O_{40}$ or $Cs_2HPW_{12}O_{40}$ respectively).

These heteropolyacids are more completely described at columns 9–12 of U.S. Pat. No. 5,334,775, which is incorporated herein by reference. Supported heteropolyacids are described in U.S. Pat. Nos. 5,391,532, 5,420,092 and 5,489,733, which are also incorporated herein by reference.

The hydrorefining process is conducted by contacting the hydrocarbon stream containing the alkyl substituted condensed ring sulfur heterocycle compounds under conditions compatible with those used in the HDS step and in the presence of hydrogen, with the catalyst system described above. This contact may be carried out by several different modes as follows:

(a) contact with a mixed bed catalyst comprising a mixture of finely divided particles of HDS catalyst and finely divided particles of ISOM catalyst. In this embodiment, the HDS catalyst and ISOM catalyst are mixed in relative proportions of about 0.2 to 5 parts by weight of HDS, more preferable about 0.5 to 1.5 parts by weight of HDS per part by weight of ISOM, and most preferably about equal parts by weight of each catalyst type. In this embodiment, the hydrocarbon feed may be passed through single or multiple beds of the catalyst system in a reactor, or through a reactor completely packed with the catalyst, followed by passage of the resulting product through a conventional high pressure gas-liquid separator to separate $H_2S$, ammonia and other volatile compounds generated in the catalytic reaction from the reactor effluent.

(b) Contact with multiple catalyst beds packed in a single reactor or individual beds packed in a plurality of reactors wherein the hydrocarbon feed is first passed through a bed of HDS catalyst, the effluent therefrom subsequently passed through a bed of ISOM catalyst and the effluent therefrom subsequently passed through a second bed of HDS catalyst. In this embodiment and where multiple reactors are used, the effluent from the first reactor may be passed through a conventional high pressure gas-liquid separator as described above (to remove $H_2S$, ammonia and other volatiles) prior to contact of the effluent with the ISOM catalyst. The effluent from the second HDS reactor is then passed through a gas-liquid separator as described above.

(c) Contact with an HDS catalyst in a first reaction zone, passage of the reactor effluent through a conventional high pressure gas-liquid separator as described above, contact of at least a portion of the separator effluent with ISOM catalyst in a second reaction zone and recycling the effluent from the second reaction zone back to the first reaction zone for contact with the HDS catalyst. In this embodiment, the effluent from the gas-liquid separator can be optionally passed through a conventional fractionator to separate the effluent into a stream rich in sulfur heterocyclic compounds (hard sulfurs) and a stream substantially free of said compounds, and only the stream rich in hard sulfurs is passed on to the second reactor zone containing the ISOM catalyst. Alternatively, the effluent from the gas-liquid separator can be first fed to an adsorber packed with an adsorbent such as activated carbon, silica gel, activated coke and the like, in which the hard sulfurs are collected. The hard sulfurs are then removed from the adsorber by contact with a suitable desorbent solvent such as toluene, xylene or highly aromatic refinery streams, which desorbent stream is then fed to the fractionator as described above to recover the liquid desorbent and produce a stream rich in hard sulfurs. This stream is then passed to the second reactor containing the ISOM catalyst and further treated as described above.

In each of the embodiments described above, the reactor bed containing the ISOM catalyst may also contain a mixture of ISOM catalyst and HDS catalyst mixed in the proportions described above.

The final product from any of these embodiments which is substantially free of sulfur-containing compounds may then be further conventionally upgraded in another reactor containing hydrogenation, isomerization, ring forming or ring-opening catalysts.

The figure shows a flow chart illustrating a preferred embodiment of the process of the invention. The hydrocarbon feed is first passed into hydrotreating reactor 1 packed with HDS catalyst where it is substantially desulfurized by removal of easy sulfurs such as unhindered DBTs. The effluent from the hydrotreater goes through a high pressure gas-liquid separator 2 (where $H_2S$ and other volatile compounds are removed) and is passed on to fractionator 3. The sterically hindered sulfur heterocycles (hard sulfurs), due to their high boiling points, end up in the bottoms stream of the fractionator. The bottom stream rich in hard sulfurs is then fed to reactor 4 packed with ISOM catalyst where the hard sulfurs are converted to easy sulfurs via isomerization and disproportionation over the solid acid catalyst. The catalyst bed used in reactor 4 may also be a mixed bed containing both an ISOM and HDS catalyst. The effluent from this reactor is then recycled back to hydrotreater 1. The sulfur-free effluent from fractionator 3 is upgraded in reactor 5 which may contain hydrogenation, isomerization, ring-forming or ring-opening catalysts.

The hydrodesulfurization and isomerization reactions of the present invention are carried out under pressure and at elevated temperatures of at least about 100° C. and in the presence of flowing hydrogen gas. Preferred conditions include a temperature in the range of from about 100 to 550° C., a pressure in the range of about 100 to about 2000 psig and a hydrogen flow rate of about 200 to about 5000 SCF/bbl. Hydrotreating conditions vary considerably depending on the nature of the hydrocarbon being hydrotreated, the nature of the impurities or contaminants to be reacted or removed, and, inter alia, the extent of conversion desired, if any. In general however,the following are typical conditions for hydrotreating a naphtha boiling within a range of from about 25° C. to about 210° C., a diesel fuel boiling within a range of from about 170° C. to 350° C., a heavy gas oil boiling within a range of from about 325° C. to about 475° C., a lube oil feed boiling within a range of from about 290°–550° C., or residuum containing from about 10 percent to about 50 percent of material boiling above about 575° C., as shown in Table. 1.

TABLE 1

| Feed | Temp. ° C. | Pressure psig | Space Velocity V/V/Hr | Hydrogen Gas Rate SCF/B |
|---|---|---|---|---|
| Naptha | 100–370 | 150–800 | 05–10 | 100–2000 |
| Diesel Fuel | 200–400 | 250–1500 | 0.5–4 | 500–6000 |

TABLE 1-continued

| Feed | Temp. ° C. | Pressure psig | Space Velocity V/V/Hr | Hydrogen Gas Rate SCF/B |
|---|---|---|---|---|
| Heavy Gas Oil | 260–430 | 250–2500 | 0.3–2 | 1000–6000 |
| Lube Oil | 200–450 | 100–3000 | 0.2–5 | 100–10,000 |
| Residuum | 340–450 | 1000–5000 | 0.1–1 | 2000–10,000 |

Where the isomerization/disproportionation reaction is carried out in a reactor zone separate from the primary hydrodesulfurization zone, similar reaction conditions as described above apply, and the temperature and space velocity are preferably selected such that unwanted side reactions are minimized.

The following examples are illustrative of the invention.

EXAMPLE 1

This example illustrates the high activity of solid acid catalysts for isomerization and disproportionation of 4-ethyl dibenzothiophene at rather mild reaction conditions. The activity test was conducted using a $CS_{2.5}H_{0.5}PW_{12}O_{40}$ heteropolyacid catalyst in a stirred autoclave operated in a semi-batch mode (flowing hydrogen) at 350° C. and 450 psig. The catalyst was precalcined prior to use at 350° C. under nitrogen. The hydrogen gas flow rate was set at 100 cc/min (room temperature).

The liquid feed used contained 5 wt % of 4-ethyl dibenzothiophene (4-ETDBT) in heptene. The amount of catalyst and liquid feed in the reactor were 2 grams and 100 cc, respectively.

The reactor effluent was analyzed with an HP 5880 Gas Chromatograph equipped with a 50 m column of 75% OVI/25% Superox™ every hour after start up and for a period of 7 hours. Analysis showed a steady decrease in the content of 4-ETDBT such that at the end of the 7 hour period, about 60% of the 4-ETDBT had been isomerized into other species including unhindered $C_2$-DBTs and disproportionated into other species including DBT itself and $C_4$-DBTs. A small amount of HDS products, such as biphenyls and cyclohexylbenzenes, were also observed.

EXAMPLE 2–4

In these examples, a series of tests were conducted to illustrate the improved efficiency of the process of the present invention in removing hard sulfurs from hydrocarbon feed vs. the HDS process conducted without isomerization and disproportionation.

All the experiments described use 4,6-diethyl dibenzothiophene (4,6-dEtDBT) as a representative refractory organosulfur species which is more difficult to desulfurize than 4-ethyl dibenzothiophene described in Example 1. The idea behind the experiments is first to achieve a synergistic removal of steric hindrance by using a mixed bed containing both a solid acid and an HDS catalyst. Subsequently, the liquid product so obtained was further desulfurized over an HDS catalyst.

All runs were conducted in a semi-batch stirred autoclave for 7.0 h at 300° C. and 3150 kPa $H_2$ pressure, with $H_2$ constantly flowing at 100 cc/min (ambient conditions). The stirring rate was set at 750 rpm to insure the absence of mass transfer effects. All catalysts were crushed and screened to 20–40 mesh. The HDS catalyst used was a commercial CoMo supported on a $SiO_2$-doped $Al_2O_3$, having a BET surface area of 200 $m^2/g$ and a pore volume of 0.42 cc/g. The CoO and $MoO_3$ contents were 5.0 wt % and 20.0 wt %, respectively. Presulfiding the catalyst was done separately in a tube furnace with a flowing 10% $H_2S/H_2$ gas mixture at 400° C. for 2 h. The solid acid catalyst was pretreated at 300°–350° C. for 1 hour under a blanket of $N_2$. Analyses of liquid products were performed with an HP 5880 G.C. equipped with a 50 m column of 75% OVI/25% Superox. The liquid feed charged was 100 cc of 5 wt % 4,6 DetDBT in dodecane. Each run consists of two experiments. In the first experiment, a uniformly mixed bed containing a solid acid and the commercial HDS catalyst, one gram of each, was used. The thus-obtained liquid product was then desulfurized with one gram of the commercial HDS catalyst in the second experiment. The products from isomerization were $C_4$ alkyl dibenzothiophenes, with the alkyl substituents away from the 6 and 4 positions. The products from disproportionation contain such species as $C_3$ alkyl dibenzothiophenes, $C_5$ alkyl dibenzothiophenes, and $C_6$ alkyl dibenzothiophenes. The desulfurized products were predominantly alkyl biphenyls, indicating that the principal HDS pathway is through direct sulfur extraction, without the need to hydrogenate the neighboring aromatic rings.

The following examples illustrate the comparative results.

EXAMPLE 2

HDS without Isomerization and Disproportionation.

In this example, the commercial HDS catalyst was used in two experiments to determine the maximum achievable HDS level without isomerization/disproportionation. The first 7 hour experiment gave an HDS level of 16.8%. Due to the low acidity of the HDS catalyst support, the extent of total isomerization/disproportionation was only 7%. The liquid product was then desulfurized for 7 hours with a fresh charge of the commercial HDS catalyst. The total HDS based on the initial charge of feed was 38.6%.

EXAMPLE 3

HDS with Isomerization and Disproportionation

The solid acid used in this example was an H form of USY zeolite Y (Si/Al=5) which was calcined at 350° C. under nitrogen. In the first experiment, simultaneous isomerization/disproportionation and HDS was achieved by using a mixed bed containing a 50/50 physical mixture of USY and the commercial HDS catalyst. A much higher HDS of 38.5% was obtained, compared with the 16.8% shown in Example 2. Moreover, this high HDS level is accompanied by a 50.4% total isomerization/disproportionation. The total liquid product was further desulfurized with the commercial HDS catalyst which gave a total HDS of 69%, compared to 38.6% in Example 2.

EXAMPLE 4

HDS with Isomerization and Disproportionation

In this example only a 50/50 mixed bed experiment was conducted using the solid acid $Cs_{2.5}H_{0.5}PW_{12}O_{40}$ 1 which was precalcined at 300° C. under nitrogen. The extent of total isomerization/disproportionation and HDS were 45.1% and 48.1%, respectively. The latter is much higher than the 16.8% reported in Example 2.

What is claimed is:

1. A process for hydrorefining a hydrotreated hydrocarbon stream containing refractory, stearically hindered, alkyl substituted, condensed ring heterocyclic sulfur compounds comprising contacting said hydrotreated hydrocarbon stream under hydrodesulfurization and isomerization conditions and in the presence of hydrogen with a mixed catalyst system comprising:

(a) a hydrodesulfurization catalyst comprising a sulfided molybdenum, tungsten or molybdenum and tungsten catalyst promoted with a transition metal; and (b) a solid acid catalyst effective for the isomerization, transalkylation and a combination of isomerization and transalkylation, of alkyl substituent groups present on said heterocyclic compounds under said hydrodesulfurization conditions.

2. The process of claim 1 wherein said mixed catalyst system comprises a mixture or a composite of said hydrodesulfurization catalyst (a) and said solid acid catalyst (b).

3. The process of claim 1 wherein said catalyst system comprises multiple catalyst beds and wherein said stream is first passed through a bed comprising hydrodesulfurization catalyst (a), the effluent therefrom subsequently passed through a bed comprising solid acid catalyst (b) and the effluent therefrom subsequently passed through a second bed comprising hydrodesulfurization catalyst (a).

4. The process of claim 1 wherein said hydrodesulfurization and isomerization conditions comprise a temperature in the range of about 100 to about 550° C., a pressure in the range of about 100 to about 2000 psig and a hydrogen flow rate of about 200 to about 5000 SCF/bbl.

5. The process of claim 1 wherein said hydrodesulfurization catalyst comprises oxides of nickel and molybdenum or of cobalt and molybdenum on an alumina or silica modified alumina support.

6. The process of claim 1 wherein said hydrodesulfurization catalyst comprises a supported, self promoted catalyst obtained by heating said support material and one or more water soluable catalyst precursors of the formula $ML(Mo_yW_{1-y}O_4)$ in a non-oxidizing atmosphere in the presence of sulfur or one or more sulfur bearing compounds for a time sufficient to form said catalyst, wherein M comprises one or more divalent promoter metals selected from the group consisting of Mn, Fe, Co, Ni, Cu, Zn and mixtures thereof, y is a value ranging from 0 to 1 and L is one or more neutral, nitrogen-containing ligands, at least one of which is a chelating polydentate ligand.

7. The process of claim 1 wherein said solid acid catalyst is selected from the group consisting of crystalline or amorphous aluminosilicates, sulfated or tungstated zirconia, niobic acid, aluminophosphates and supported or bulk heteropolyacids or heteropolyacid salts.

8. The process of claim 7 wherein said solid acid catalyst is a zeolite.

9. The process of claim 8 wherein said zeolite is promoted by a hydrogenation metal.

10. The process of claim 7 wherein said solid acid catalyst is a heteropolyacid compound having the structure $H_zD_t^+{}_nXM_{12}O_{40}$ wherein z+nt=3, o≦z, t≦3, D is a metal cation of valence n, X is a hetero atom selected from the group consisting of one or more metals, metalloids and non-transition metals of Groups III A to VA, and M is a poly atom comprising one or more Group VB or VIB transition metals.

11. The process of claim 10 wherein M is tungsten or molybdenum and X is selected from the group consisting of titanium, zirconium, boron, aluminum, silicon, phosphorous, germanium, arsenic, tin and tellurium.

12. The process of claim 11 wherein said heteropolyacid is selected from the group consisting of phosphomolybdic acid, silicomolybdic acid, arsenomolybdic acid, telluromolybdic acid, aluminomolybdic acid, silicotungstic acid, phosphotungstic acid, borotungstic acid, titanotungstic acid, stannotungstic acid, phosphovanadyltungstic acid and salts thereof.

13. The process of claim 1 wherein said hydrocarbon stream is selected from the group consisting of solvents, light, middle or heavy distillate feeds, residual feeds and fuels.

14. The process of claim 1 wherein said alkyl substituted condensed ring heterocyclic sulfur compounds comprise one or a mixture of 4-alkyl, 6-alkyl or 4,6-dialkyl dibenzothiophenes and sterically hindered sulfur compounds.

15. The process of claim 1 wherein said solid acid catalyst of (b) is mixed with said hydrodesulfurization catalyst.

16. A process for hydrorefining a hydrocarbon stream containing refractory stearically hindered, alkyl substituted condensed ring heterocyclic sulfur compounds comprising:

(a) contacting said stream in a first reaction zone under hydrodesulfurization conditions with a catalyst comprising a sulfided molybdenum, tungsten or molybdenum and tungsten catalyst promoted with a transition metal; and (b) withdrawing an effluent stream from said first zone containing both light and heavy refractory sulfur compounds;

(c) separating said light sulfur compounds from said effluent stream to form a second stream containing said refractory heterocyclic sulfur compounds;

(d) contacting at least a portion of said second stream in a second reaction zone with a solid acid catalyst under conditions suitable for both hydrodesulfurization and isomerization and in the presence of hydrogen effective for the isomerization of alkyl substituent groups present on said refractory heterocyclic sulfur compounds; and (e) recycling the effluent from said second reaction zone back to said first reaction zone and subjecting said effluent to said hydrodesulfurization conditions.

17. The process of claim 16 wherein said solid acid catalyst in said second reaction zone comprises a mixture of said solid acid catalyst and said sulfided catalyst.

18. The process of claim 16 wherein said second stream from step (c) is separated into a stream rich in said refractory heterocyclic sulfur compounds and a stream substantially free of said heterocyclic sulfur compounds, and wherein only said stream rich in said refractory heterocyclic sulfur compounds is fed to said second reaction zone.

19. The process of claim 16 wherein said hydrodesulfurization and isomerization conditions comprise a temperature in the range of about 100 to about 550° C., a pressure in the range of about 100 to about 2000 psig and a hydrogen flow rate of about 200 to about 5000 SCF/bbl.

20. The process of claim 16 wherein said hydrodesulfurization catalyst comprises oxides of a nickel and molybdenum or of cobalt and molybdenum on an alumina or silica modified alumina support.

21. The process of claim 16 wherein said hydrodesulfurization catalyst comprises a supported, self promoted catalyst obtained by heating said support material and one or more water soluable catalyst precursors of the formula $ML(Mo_yW_{1-y}O_4)$ in a non-oxidizing atmosphere in the presence of sulfur or one or more sulfur bearing compounds for a time sufficient to form said catalyst, wherein M comprises one or more divalent promoter metals selected from the group consisting of Mn, Fe, Co, Ni, Cu, Zn and mixtures thereof, y is a value ranging from 0 to 1 and L is one or more neutral, nitrogen-containing ligands, at least one of which is a chelating polydentate ligand.

22. The process of claim 16 wherein said solid acid catalyst is selected from the group consisting of crystalline or amorphous aluminosilicates, sulfated and tungstated zirconia, niobic acid, aluminophosphates and supported or bulk heteropolyacids or heteropolyacid salts.

23. The process of claim 22 wherein said solid acid catalyst is a zeolite.

24. The process of claim 23 wherein said Zeolite is promoted with a hydrogenation metal.

25. The process of claim 22 wherein said solid acid catalyst is a heteropolyacid compound having the structure $H_zD_t^{+n}XM_{12}O_{40}$ wherein z+nt=3, o≦z, t≦3, D is a metal cation of valence n, X is a hetero atom selected from the group consisting of one or more metals, metalloids and non-transition metals of Groups III A to VA, and M is a poly atom comprising one or more Group VB or VIB transition metals.

26. A process according to claim 1 or 16 wherein said transition metal is selected from the group consisting of Mn, Fe, Co, Ni, Cu, Zn, and mixtures thereof.

* * * * *